US006241949B1

(12) United States Patent
Kane

(10) Patent No.: US 6,241,949 B1
(45) Date of Patent: Jun. 5, 2001

(54) SPILL-RESISTANT MICROTITRE TRAYS AND METHOD OF MAKING

(75) Inventor: Thomas E. Kane, State College, PA (US)

(73) Assignee: Spectrumedix Corporation, State College, PA (US)

( * ) Notice: Subject to any disclaimer, the term of this patent is extended or adjusted under 35 U.S.C. 154(b) by 0 days.

(21) Appl. No.: 09/376,076

(22) Filed: Aug. 17, 1999

(51) Int. Cl.[7] ..... B01L 3/00

(52) U.S. Cl. ..... 422/102; 422/99; 422/100; 422/101; 422/103; 422/104; 435/287; 435/293; 435/300

(58) Field of Search ..... 422/99–104; 435/287, 435/293, 300, 301; 222/143, 330

(56) References Cited

U.S. PATENT DOCUMENTS 5,342,581 * 8/1994 Sanadi ..... 422/101
5,650,323 * 7/1997 Root ..... 435/284.1
6,027,694 * 2/2000 Boulton et al. ..... 422/102
6,083,761 * 7/2000 Kedar et al. ..... 436/178
6,106,783 * 8/2000 Gamble ..... 422/102
6,106,784 * 8/2000 Lund et al. ..... 422/104
6,136,273 * 10/2000 Seguin et al. ..... 422/99

* cited by examiner

*Primary Examiner*—Jill Warden
*Assistant Examiner*—Dwayne K. Handy
(74) *Attorney, Agent, or Firm*—Pennie & Edmonds LLP

(57) ABSTRACT

Microtitre trays and their spill-resistant open lids prevent cross contamination of samples and also accommodate fragile and flexible probes of automated biological sample analysis systems. The open-lids can be in the form of sleeves located on the top sides of each well of microtitre trays. In one version, one microtitre tray with its bottom sections severed is stacked on top of another microtitre tray to provide the open-lids. A cutting tool is also provided to sever the bottom sections of each well from microtitre trays. The cutting tool includes a lever, a blade and a clamping device.

11 Claims, 11 Drawing Sheets

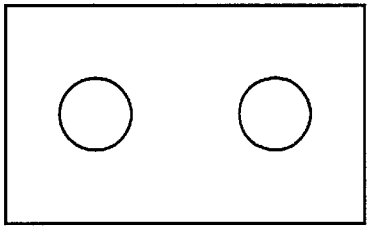
FIG. 12a
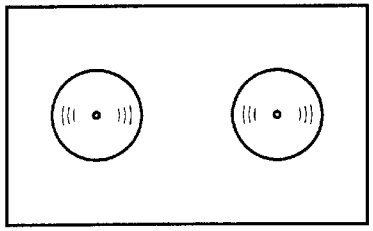
FIG. 12b
FIG. 12c
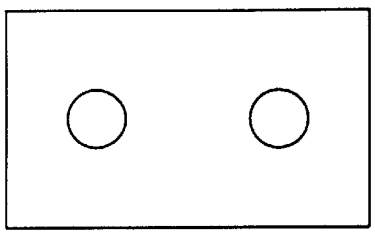
FIG. 12d
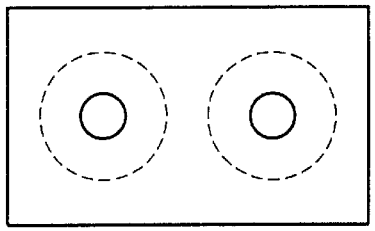
FIG. 12e
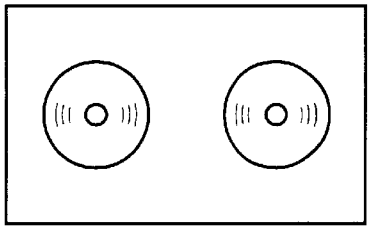
FIG. 12f
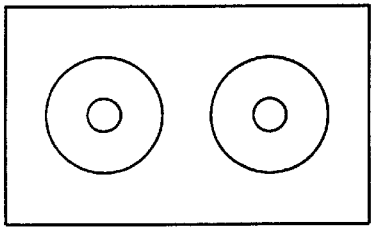
FIG. 12g
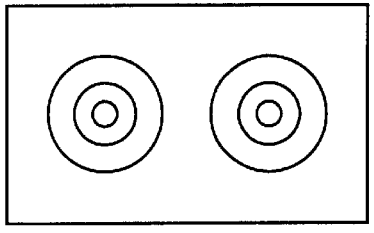
FIG. 12h

SPILL-RESISTANT MICROTITRE TRAYS AND METHOD OF MAKING

FIELD OF THE INVENTION

The present invention relates to microtitre trays and their spill-resistant open lids that prevent cross contamination of samples and also accommodate fragile and flexible probes of automated biological sample analysis systems.

BACKGROUND OF THE INVENTION

Referring to FIG. 1, a conventional microtitre tray includes a two-dimensional array of wells arranged in one common plane when viewed from its top. Liquid biological samples are placed in some or all of the wells and analyzed. For instance, biological samples, e.g., for DNA sequencing, are often placed and transported in microtitre trays. In addition, reagents can be added to the samples in the wells and/or other treatments such as heating, cooling, centrifuging, filtering, diluting can be performed on the samples in the wells. Subsequently, in many cases the samples are taken directly from a microtitre tray and inserted into an analysis system, e.g., a DNA sequencer, for further detailed clinical analysis.

During the above described processes, the samples in the wells can spill or leak out from the wells. In some instances, the leaked out samples can flow into other wells. This causes loss of valuable samples, cross contamination thereof and renders the samples useless for any clinical analysis. Further, even if there is only a negligible probability of the cross contamination, when the results of the clinical analysis are to be presented to a peer review or a lay person review, i.e., a jury or a tribunal, the process of reducing the chance of cross contamination may become relevant evidence in interpreting the results of the clinical analysis.

In order to avoid the cross contamination problem, conventional microtitre trays are provided with closed lids that tightly fit over each of the wells. The lids may reduce the chance of the cross contamination and the loss of samples to nil. However, this solution, hinders the use of automated analysis systems by requiring the use of cumbersome robotic arms to remove the lids.

An automated system utilizes the uniform characteristics of microtitre trays, e.g., the location and sizes of well openings. In other words, introduction of samples into microtitre wells can be achieved by a two-dimensional array of syringes arranged to match with the locations of the well openings. Further, a two-dimensional array of probes can be inserted into the wells of a microtitre tray for clinical analysis of the sample simultaneously. Other examples of automated analysis systems include micropipeting work station, which is a robotic station, that would perform all of the sample transfer and other processes automatically.

In the above described exemplary automated systems, the closed lids require an additional step of removing the lids. If this lid removal step is to be automatically performed, then an additional mechanism to remove the lids and to test whether or not all the lids have been removed would be required. This makes automated analysis systems more cumbersome and expensive.

In one alternative embodiment, loose-fitting lids are provided to lessen the force required to remove the lids by the automated analysis systems. The loose lids, however, introduce additional risks, such as unwanted removal during sample transport, and the need to ensure the lid was properly replaced after the sample was accessed.

As another alternative, an aluminum foil or an adhesive backed aluminum foil can be used to cover the opening of the wells. In this alternative, the foil is peeled away or pierced through by syringes or probes that need to access the wells. Another alternative is to use septum-based sample lids. Similar to the foil, the septum-based lid is pierced by the syringes or probes to access the wells. All of those embodiments require additional hardware to automate. For instance they require feedback systems to ensure that the piercing or removing the foil is in fact achieved.

In some automated analysis systems, only fragile or flexible probes can be utilized. These probes would not be sufficiently rigid to penetrate or pierce through the foils or the septum-based lids discussed above. An example of these types of probes is used in an automated capillary electrophoresis system described in U.S. Pat. No. 5,885,430 which is incorporated herein by reference. Another example of fragile and flexible probes are small fiberoptic tips utilized for analysis of samples using absorption or emission techniques.

Therefore, it would be desirable to provide a lid mechanism to microtitre trays that can prevent cross contamination of samples and, simultaneously, can accommodate the fragile and flexible probes described above.

SUMMARY OF THE INVENTION

Accordingly, the present invention provides microtitre trays with a one or two-dimensional array of wells and with open-lids that are spill-resistant to prevent cross contamination of samples and also to accommodate fragile and flexible probes of the automated biological sample analysis systems.

More specifically, the present invention includes an array of connected wells. Each well includes a circumferential wall forming a hollow, elongated mid-section having a first and second ends. The circumferential wall defines an opening at the first end. Each well further includes a bottom section liquid tightly closing the second end and a circumferential sleeve located near the first end of the wall and extending toward the second end. When the well is tilted, a liquid sample is trapped between the sleeve and the wall. The bottom section of each well includes a side portion connected to the second end of the circumferential wall, and a center portion sagging below the side portion, wherein the liquid sample collects on the center portion when the liquid sample is introduced into the well.

The circumferential sleeve forms substantially similar shape as that of its well and includes an opening in its bottom section. The sleeve around the opening is made from moderately flexible and elastic plastic material. This allows the opening to be opened or closed depending upon whether a probe is inserted therethough or not, respectively.

The present invention further provides a method of manufacturing open-lids for a microtitre tray. The method includes the steps of fabricating a modified microtitre tray which includes wells without respective bottom sections, fabricating an unmodified microtitre tray which includes wells having a same spacing as those in the modified microtitre tray, and stacking the modified microtitre tray onto the unmodified microtitre tray.

The step of fabricating the modified microtitre tray may further include the step of either molding a microtitre tray without bottom sections of its wells or severing bottom sections of a microtitre tray. If desired, the severing step may cut the bottom sections of each well simultaneously.

The present invention also includes a cutting tool for severing bottom sections of wells of a microtitre tray. The cutting tool includes a blade and a tray holder configured to grip the microtitre tray. The tray holder renders the microtitre tray substantially immovable when the bottom sections are being cut by the blade. The cutting tool also includes a blade guide configured to direct the blade to sever the bottom sections of the wells.

The cutting tool also may include a clamp pivotally mounted on the tray holder and configured to securely grip the microtitre tray when the clamp is pivoted toward the tray holder.

If desired the blade may also include an array of openings defined therein to receive the bottom portions of the wells and an array of crescent-shaped blades located on one side of each opening. This embodiment severs the bottom sections when the blade is moved in a predetermined direction. Further, the blade can be mounted on the microtitre holder to be moved laterally with respect thereto.

Also the cutting tool may include a lever pivotally mounted on the tray holder and a link operationally coupled to the lever and the blade and configured to convert rotating force exerted by the lever into lateral movement force exerted onto the blade when the lever pivots toward the tray holder.

The tray holder may further include an array of openings defined therein. The openings are configured to receive the wells of the microtitre tray and co-located with the array of openings of the blade when the lever is pivoted away from the tray holder.

BRIEF DESCRIPTION OF THE DRAWINGS

Preferred features of the present invention are disclosed in the accompanying drawings, wherein similar reference characters denote similar elements throughout the several views, and wherein:

FIGS. 12*a*–12*h* are top views of the different embodiments of strips of sleeves.

DETAILED DESCRIPTION OF THE INVENTION

Figure 1:
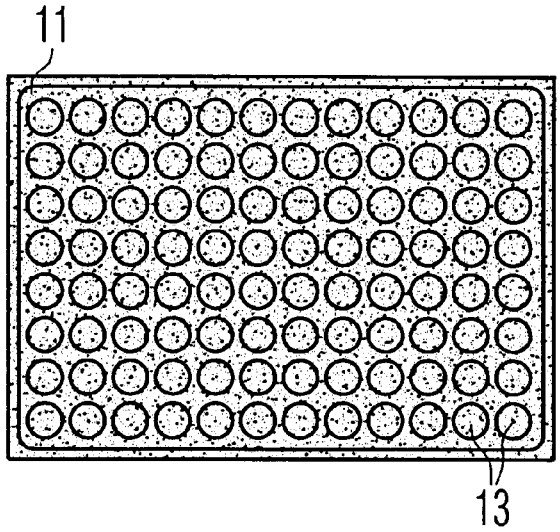
FIG. 1 is a top view of a 8 by 12 well microtitre tray.

Referring back to FIG. 1, there is shown a tray 11 preferably made of semi-rigid plastic material. The tray 11 is molded to connect a two-dimensional array of wells 13 as illustrated in FIG. 1. In alternative embodiments, a microtitre tray may only be a one-dimensional array, or a strip, of wells connected together. However, a microtitre tray should include at least two wells but there is no maximum number of wells that can be included in a microtitre tray. Wells of a microtitre tray can be arranged in a square grid layout as shown in FIG. 1. In an alternative embodiment, the wells can be arranged in a honeycomb grid as well.

Usually, the microtitre trays come in standard sizes. In the biotech industry, the currently preferred microtitre tray has a rectangular array comprising of 8 rows and 12 columns of wells. The centers of adjacent wells found in a single row are separated by approximately ⅜ in. The length of the wells is approximately ¾ in, and the diameter of the wells is approximately ¼ in. The same holds for the spacing between adjacent wells in a single column. Volume of a well is approximately 250 micro-liters.

Miniaturization has allowed more wells to be accommodated in a single microtitre tray having the same footprint. New trays having four times the density of wells within the same footprint have already been introduced and are fast becoming the industry standard. Thus, the centers of adjacent wells found in a single row are separated by approximately 3/16 in. In this embodiment, the length of the wells is approximately ⅜ in, and the diameter of the wells is approximately ⅛ in. The above figures may vary by one or two tenths of an inch. Volume of a well of this microtitre tray is approximately 50–100 micro-liters.

Figure 2:
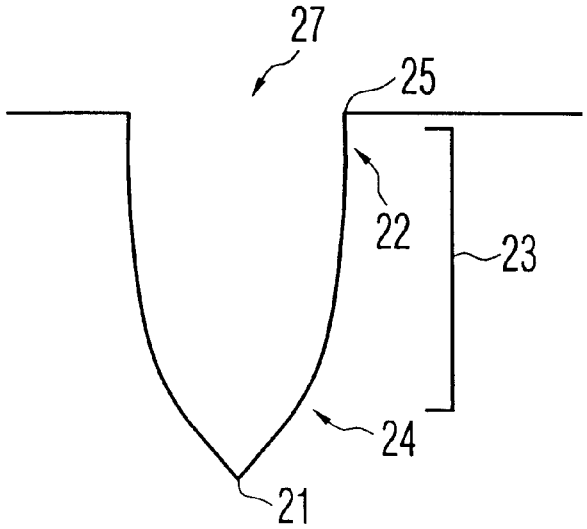
FIG. 2 is a cross-sectional view of a mictrotitre well.

Now referring to FIG. 2, each well of the present invention includes a bottom 21, mid 23 and top 25 sections. The bottom section 21 is where sample is to be collected when it is injected into the well. The mid-section 23 ensures the structural integrity of the well. Finally, the top section 25 includes an opening 27 to receive the sample. The wells are preferably made from semi-rigid plastics by molding processes.

The mid-section 23 is a hollow and elongated circumferential wall having a top 22 and bottom 24 ends. A cross-section of the wall preferably forms a substantially circular shape. In alternative embodiments, the cross-section may take other shapes such as ellipsoidal or polygonal shapes. In turn, the cross-section of the wall defines the shape of the opening 27 located at the top end 22 of the wall.

At the bottom section 21, located at the bottom side 24 of the mid-section 23, all sides of the wall taper inwardly, meet together and form a pointed bottom. When a sample is introduced into the well, the sample is collected on the pointed bottom. It should be noted that a typical sample amount is in the range of 200–1000 micro-liters or in the range of approximately 250 micro-liters.

The bottom section 21 and the mid-section 23 of a well preferably have a hollow conical shape. In other words, if the cross-section of the mid-section is a circle with decreasing radii from the top to the bottom ends and if the bottom section has a pointed center portion, then the shape of the mid-section and the bottom section together form a hollow cone. In alternative embodiments, a well may have a hollow tetrahedron or pyramid shape.

FIGS. 3*a*–3*h* show that wells in accordance with the present invention further include an open-lid in the form of a circumferential sleeve located inside each well near the respective top sections. The sleeves, which start near the top sections, extend toward the bottom sections.

Figure 3A:
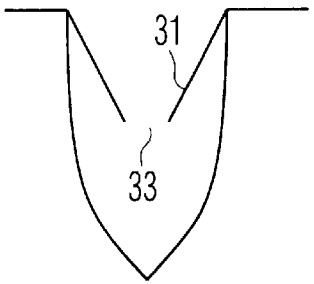
FIGS. 3*a*–3*h* are cross-sectional views of wells with a variety of open-lid configurations of the present invention.

In an embodiment depicted in FIG. 3*a*, its sleeve 31 extends from the top section of the well toward the bottom section of the well. The general shape of the sleeve is substantially similar to that of the well. In other words, as the well has a hollow cone shape, the sleeve also has a hollow cone shape except its bottom section includes an opening 33. Both the well and its sleeve can take any of the alternative well shapes discussed above.

Figure 3B:
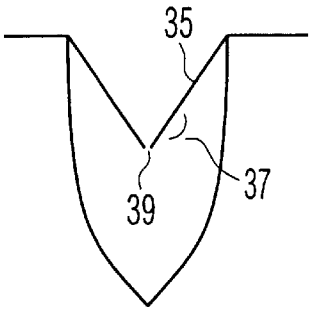

Referring to FIG. 3*b*, its sleeve 35 actually forms a hollow cone similar to that of its well. However, in this embodiment, bottom section 37 of the sleeve is made from elastic and flexible plastic material. The bottom section 37 further includes a small orifice 39 that is closed due to the elastic characteristic of the bottom section 37. When a probe is inserted through the orifice 39, the orifice opens to allow the probe to access the sample located in the well. Therefore, it should be noted that the plastic material that makes up the bottom section 37 is preferably sufficiently flexible and elastic so as to allow the probe to pass through the orifice 39 and to close the orifice 39 when there is no probe.

Figure 3C:
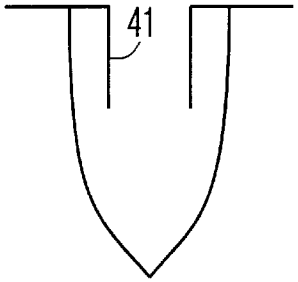
Figure 3D:
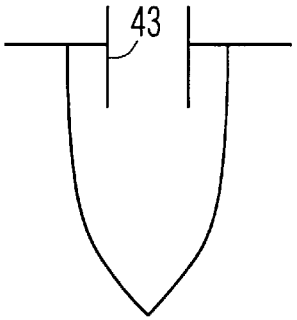
Figure 3E:
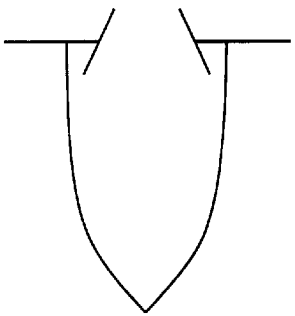
Figure 3F:
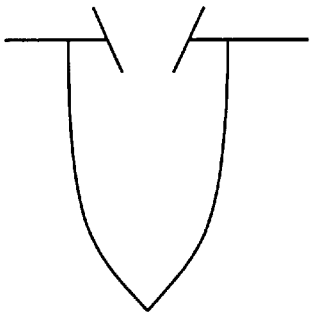
Figure 3G:
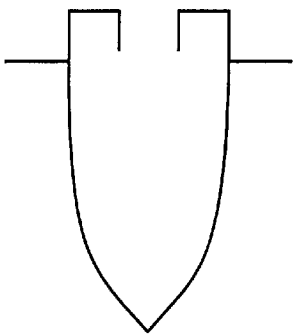
Figure 3H:
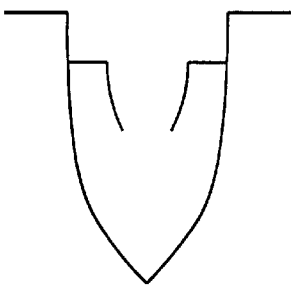

In another embodiment depicted in FIG. 3*c*, its sleeve 41 extends toward the bottom section of its well in a hollow cylindrical shape. In yet another embodiment illustrated in FIG. 3*d*, sleeve 43 extends toward the bottom section of the well and also protrude outwards and above the plane of the well. In other embodiments depicted in FIGS. 3*e* and 3*f*, the sleeves slant either inwardly or outwardly. Finally, in embodiments shown in FIGS. 3*g* and 3*h*, the sleeves are either located entirely outside or inside of respective wells.

It should be noted that a common characteristic among the various sleeve embodiments discussed above is that a sample located on the respective bottom section would not spill out to the top opening when the well is tilted. For instance, as long as the volume of the sample is sufficiently small, the sample on the bottom would simply move along the wall and then be caught between the sleeve and the wall when the well is tilted at an extreme angle or even when held upside down. It should be noted that other sleeve configurations similar to the above described embodiments are contemplated within this invention.

The lengths of the sleeves should be sufficiently long such that the space between the wall and the sleeve can trap an anticipated volume of samples. More specifically, the lengths of the sleeves can be from one-fourth to the three-fourths of the length of the well.

Figure 4A:
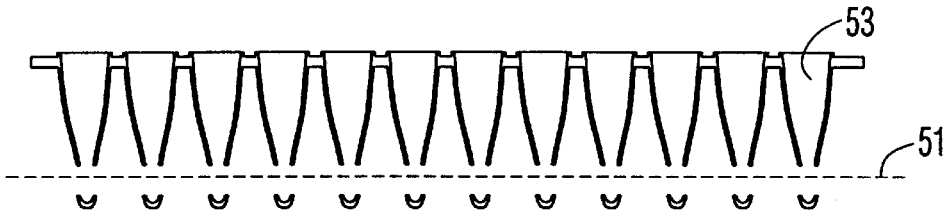
FIG. 4*a* is a cross sectional view of one row of wells illustrating the location where bottom sections of the wells are severed from the rest of the wells.

A microtitre tray having the open-lid structure, i.e., the sleeve, is preferably manufactured using two conventional microtitre trays. Referring to FIG. 4*a*, the bottom section of each well in a microtitre tray is severed, i.e., cut, from the rest of first microtitre tray along a cutting plane 51, thereby producing a modified microtitre tray 53. In an alternative embodiment, a modified microtitre tray 53 can be molded without its bottom sections, thereby eliminating the cutting step.

Figure 4B:
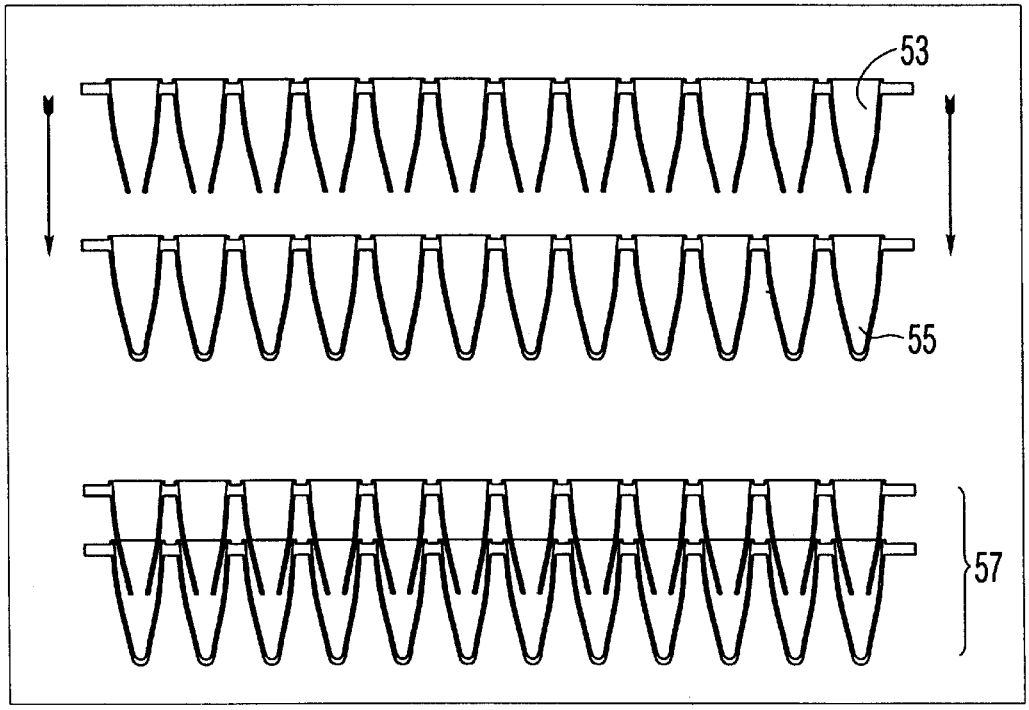
FIG. 4*b* is a schematic diagram illustrating how a microtitre tray with an open-lid is manufactured using a microtitre tray with its bottom sections severed as shown in FIG. 3*a;*

The modified microtitre tray 53 is then inserted into an unmodified microtitre tray 55 as illustrated in FIG. 4*b*. A contact region 59, where the two microtitre trays touch each other, is then created. Since wells are made from semi-rigid plastic material, the wells of the modified microtitre tray 53 are deformed at the contact region 59 when forcibly inserted into the wells of the unmodified microtitre tray 55. The deformed wells of the modified microtitre tray then effectively fasten the modified microtitre tray 53 to the unmodified microtitre tray 55 by frictional force therebetween. In an alternative embodiment, an adhesive, e.g., glue, or heat can be applied between the two trays to ensure more secure affixation therebetween. It should be noted that when heat is applied, a fused contact region is created between the two trays.

The present invention comtemplates that the modified microtitre tray 53 may have a larger number of wells than the unmodified microtitre tray 55, or vice versa. Further, even if the modified microtitre tray 53 has identical number and arrangement of wells as that of the unmodified microtitre tray 55, the two trays are not required to be aligned in manufacturing a stacked two tray arrangement 57.

Figure 11C:
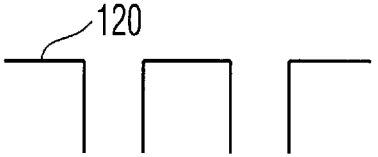
FIGS. 11*a*–11*h* are cross-sectional views of different embodiments of strips of sleeves.
Figure 11F:
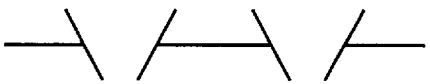
Figure 11B:
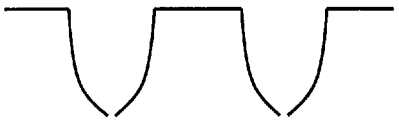
Figure 11E:
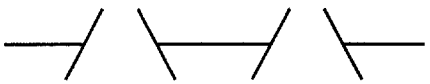
Figure 11H:
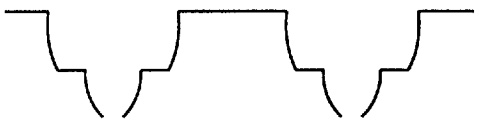
Figure 11A:
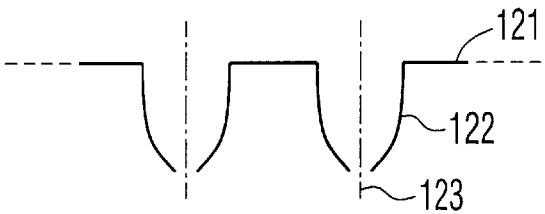
Figure 11D:
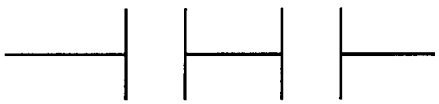
Figure 11G:
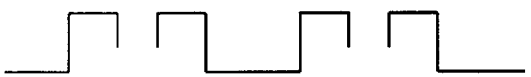

As it can be shown in FIG. 4*b*, the stacked two tray arrangement 57 effectively creates the sleeve 31 depicted in FIG. 3*a*. Alternatively, a spill-resistant lid member including a one-dimensional, i.e, a strip, or a two-dimensional array, of individual lid units having sleeve like walls depicted in FIGS. 11*a*–11*h* can be utilized to manufacture a device in accordance with the present invention. Exemplary strips of the sleeve like idividual lid units corresponding to the sleeves illustrated in FIGS. 3*a*–3*h* are depicted in FIGS. 11*a*–11*h* and FIGS. 12*a*–12*h*. For instance, the spill-resistant lid member 120 of FIG. 11*c* corresponds to the sleeve 41 of FIG. 3*c*.

More specifically, the spill-resistant lid member preferably includes a substantially planar member 121 and a regularly spaced one- or two-dimensional array of individual lid units formed in the planar member 121. Each individual lid unit includes a circumferential wall having a central axis 123 and defining a top and bottom opening. The wall tapers off from the top opening in a direction away from the planar member 121 and terminates at the bottom opening. The central axes of adjacent individual units are spaced from one another corresponding to that of adjacent wells of a row (one-dimensional) or array (two-dimensional) standard microtitre tray discussed above.

It should be noted that the sleeves depicted in FIGS. 11*a*–11*h* and 12*a*–12*h* are for sleeves having circular cross-sectional shape. In alternative embodiments, the cross-sectional shape of sleeves can be ellipsoidal or polygonal. It should also be noted that even though strips of sleeves depicted in FIGS. 11*a*–11*h* and 12*a*–12*h* include only two sleeves each, two-dimensional arrays of sleeves are also contemplated within this invention as described above.

Figure 5A:
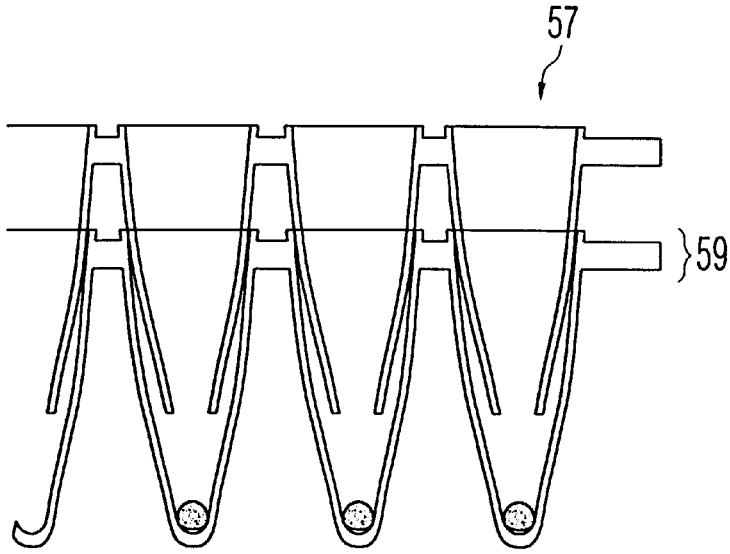
FIGS. 5*a* and 5*b* show cross-sectional views of one row of wells with their lids for capturing samples within tilted wells.
Figure 5B:
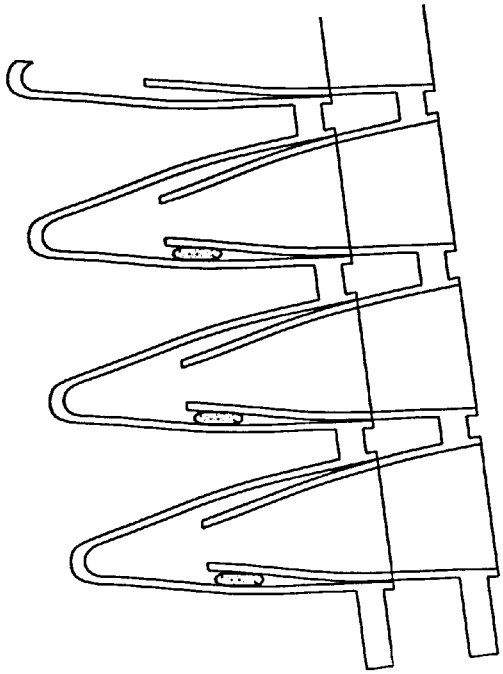
Figure 6:
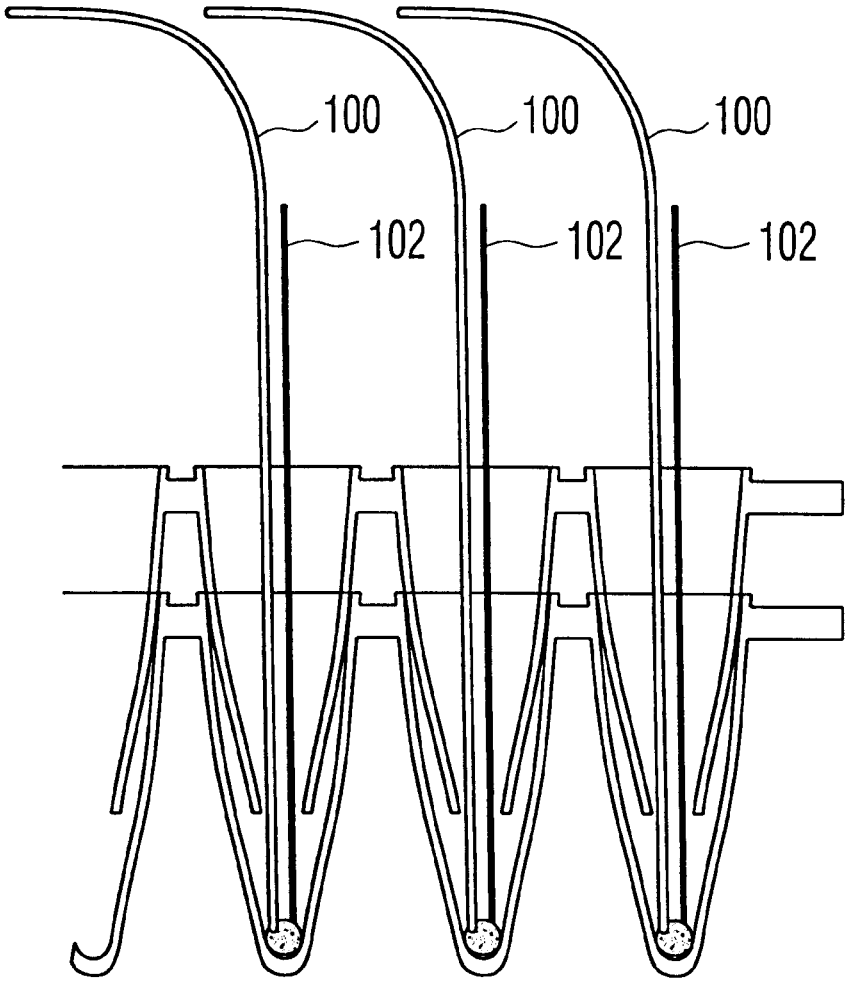
FIG. 6 is a cross-sectional view of one row of wells with their corresponding probes and electrodes inserted thereto.

Referring to FIGS. 5*a* and 5*b*, the stacked two tray arrangement 57 reduces the risk of cross contamination of samples injected therein. Further, the stacked two tray arrangement 57 allows easy access to the sample through the top opening with a flexible or fragile probe tip. In addition, when two identically manufactured microtitre trays are utilized to make the open-lid microtitre tray, it exhibits added benefits of minimal variations in locations and overall shapes, e.g., outer and inner diameters of the openings. This insures compatibility in automated analysis systems. For instance, when an array of probes, such as an array of capillaries 100 and an array of electrodes 102, is arranged in accordance with sizes and locations of openings of the unmodified microtitre tray, then the locations of the probes need not be adjusted when the modified microtitre tray is stacked on the unmodified microtitre tray as shown in FIG. 6. It should be noted that other exemplary probes include fiberoptic sensors or other similar biological sample analysis probes.

It should be noted, however, that the probe length is preferably sufficiently long to clear both the stacked trays. Further, the size of the opening is preferably sufficiently large to receive a multiple of probes, as shown in FIG. 6. The modified tray can be further adjusted to fit closer to the unmodified tray resulting in a sleeve configuration similar to that of the sleeve configuration depicted in FIG. 3*a*.

Figure 7A:
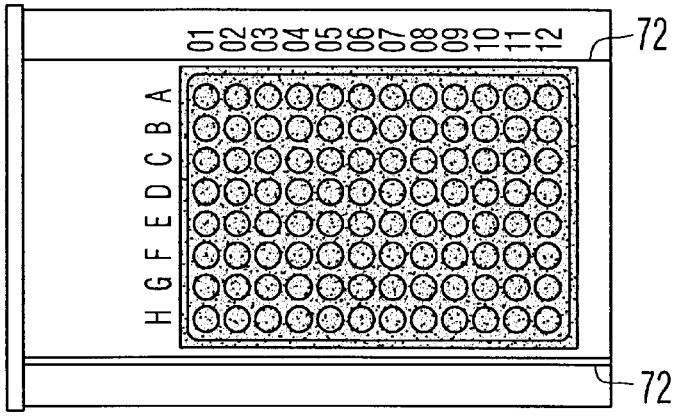
FIG. 7*a* is a top view of a tray holder.
Figure 7B:
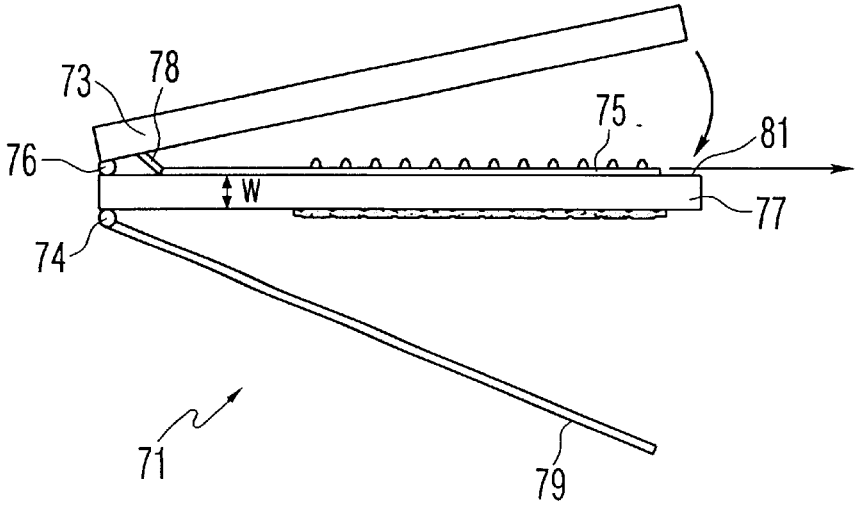
FIG. 7*b* is a side view of a first embodiment cutting tool.

Now referring to FIG. 7*b*, there is shown a cutting tool 71 to sever bottom sections from microtitre trays. The cutting tool 71 includes a lever 73, a blade 75, a microtitre tray holder 77 and a clamp 79.

The microtitre tray holder 77 includes a two-dimensional array of openings sized to snugly receive wells of a microtitre tray, as shown in FIG. 7*a*. The width, W, of the microtitre tray holder 77 is less than the length of wells of microtitre trays. Therefore, when a microtitre tray is placed in the microtitre tray holder 77, as shown in FIG. 7*b*, only the bottom sections of the wells protrude through the cutting surface 81 of the microtitre tray holder 77.

The microtitre tray holder 77 includes a cutting surface 81 and a set of side grooves 72. The side grooves 72 and the cutting surface 81 provide a guide for the blade 75 so as to allow the blade 75 to freely move back and forth with respect to the microtitre tray holder 77.

The clamp 79 is pivotally mounted on the microtitre tray holder 77 by a hinge 74. This allows the clamp 79 to pivot away from or toward the microtitre tray holder 77. When the clamp 79 is pivoted away from the microtitre tray holder 77, a microtitre tray, whose bottom sections are to be cut, is inserted into the openings of the microtitre tray holder 77. Once the microtitre tray is inserted, the clamp 79 is pivoted toward the microtitre tray holder 77, thereby securely gripping the microtitre tray in the microtitre tray holder 77.

The lever 73 is also pivotally mounted on the microtitre tray holder 77 by a hinge 76. When the lever is pivoted away from the microtitre tray holder 77, the cutting tool is in its inactive mode, during which a microtitre tray can be inserted into the microtitre tray holder 77. When the lever is pivoted toward the microtitre tray holder 77, the cutting tool is in its cutting mode, during which the bottom sections of the wells are being cut by the blade 75.

As discussed above, the blade 75 is mounted on the cutting surface 81 of the microtitre tray holder 77. The blade 75 also includes a two-dimensional array of openings 91, as shown in FIG. 8*d*. The blade openings are co-located with the openings in the microtitre tray holder 77 when the cutting tool is in its inactive mode.

Figure 8A:
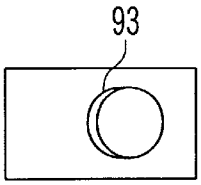
FIG. 8*a* is a top view of an opening of a blade with its crescent blade of the first embodiment cutting tool.
Figure 8B:
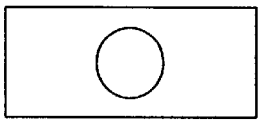
FIG. 8*b* is a top view of an opening of a tray holder corresponding to the opening of the blade illustrated in FIG. 6*a* with 96 separate blades.
Figure 8C:
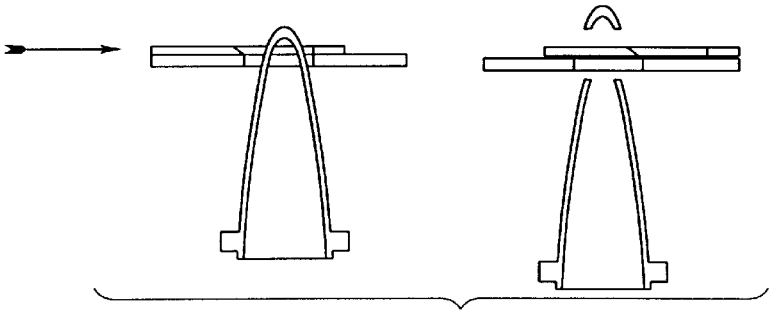
FIG. 8*c* are schematic diagrams illustrating a cutting process of a bottom section of one well.
Figure 8D:
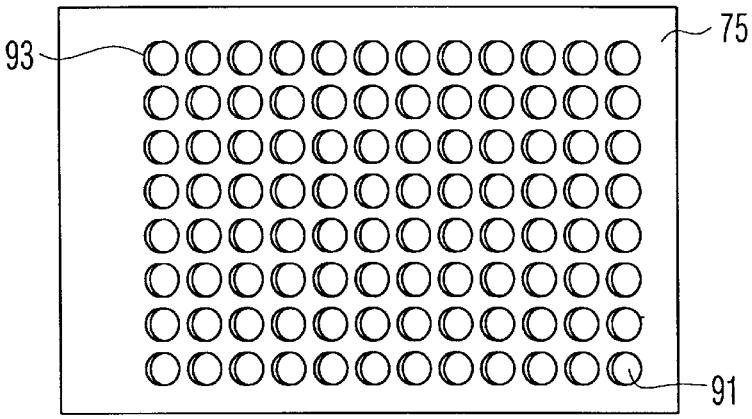
FIG. 8*d* is a top view of the blade with a two-dimensional arrangement of openings and corresponding crescent blades.
Figure 8E:
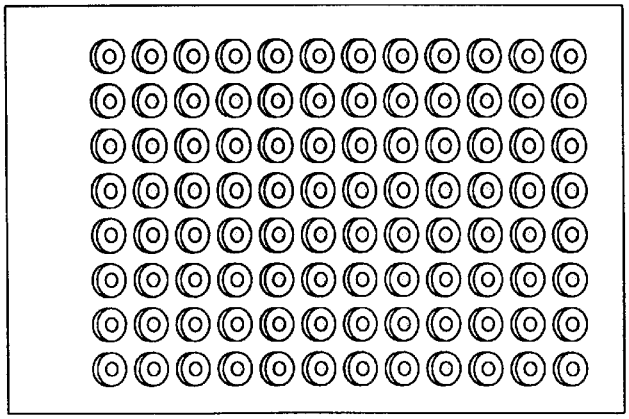
FIG. 8*e* is a top view of a tray holder with its two-dimensional arrangement of openings co-located with the openings of the blade and sized to receive wells of a microtitre tray.

Further, each of the blade openings 91 includes a crescent-shaped small blade 93 as shown in FIG. 8*a*. Referring back to FIG. 7*b*, during the cutting mode, the blade 75 is pushed toward the direction that the small crescent shaped blades 93 can cut respective protruding bottom sections of the wells.

In the preferred embodiment, the lever 73 assists the cutting process. More specifically, the lever 73 is operationally engaged with the blade 75 via a link 78. As the lever 73 is rotated toward the microtitre tray holder 77, the link 78 transforms the pivotal force exerted by the lever 73 into lateral force. In turn, the link 78 exerts the lateral force onto the blade 75 which causes the blade 75 to move laterally. This causes the crescent-shaped blades 93 to cut the protruding bottom sections of the wells. In addition, the severed parts, i.e., the bottom sections, of the wells are collected on the blade 75 and disposed conveniently.

Figure 9A:
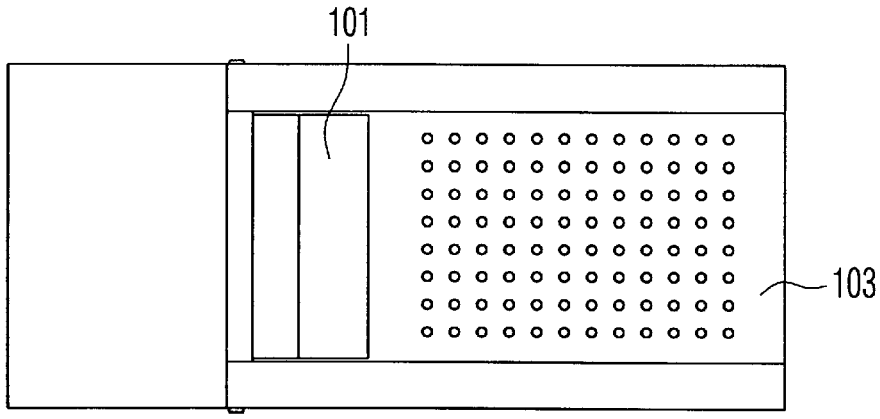
FIG. 9*a* is top view of a second embodiment cutting tool.
Figure 9B:
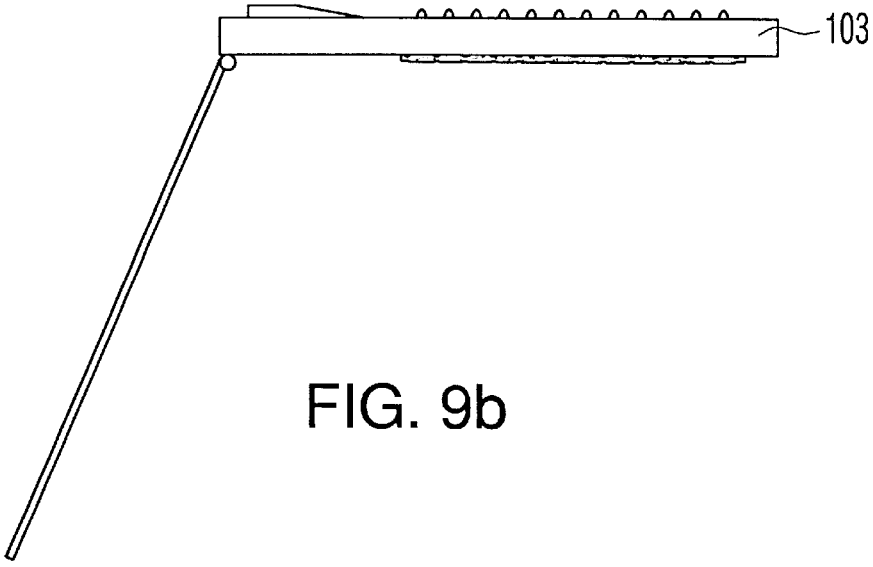
FIG. 9*b* is a side view of the second embodiment cutting tool with a microtitre tray inserted thereto.
Figure 9C:
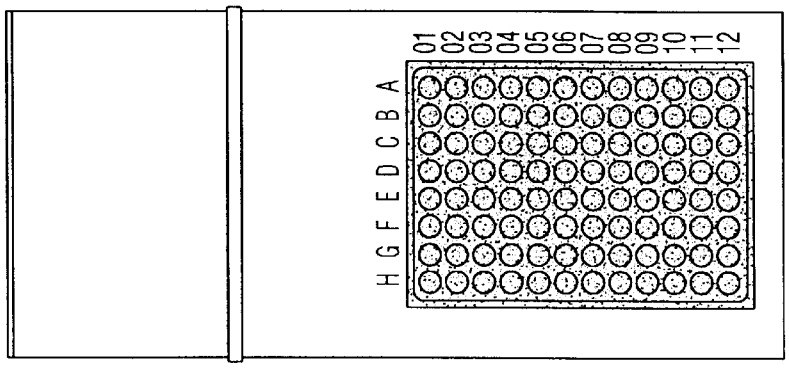
Figure 10A:
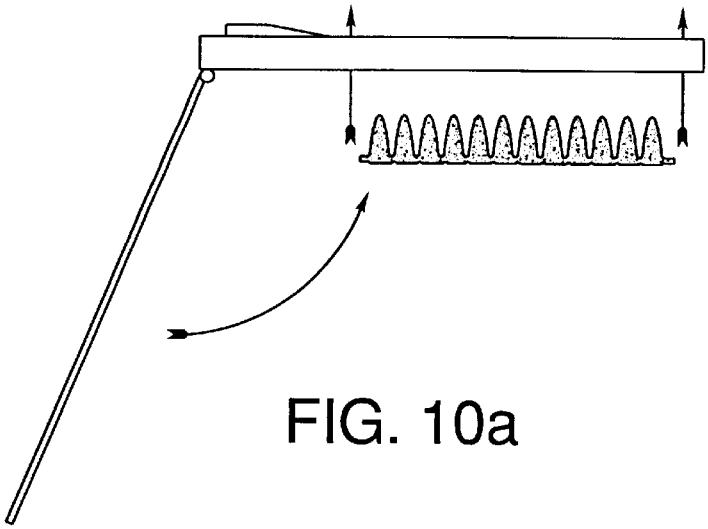
FIGS. 10*a*–10*d* are schematic views depicting cutting operation of the second embodiment cutting tool.
Figure 10B:
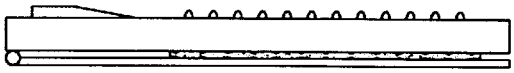
Figure 10C:
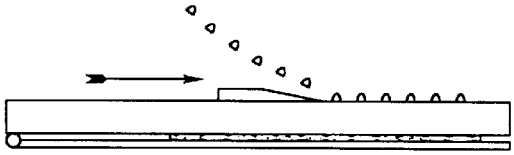
Figure 10D:
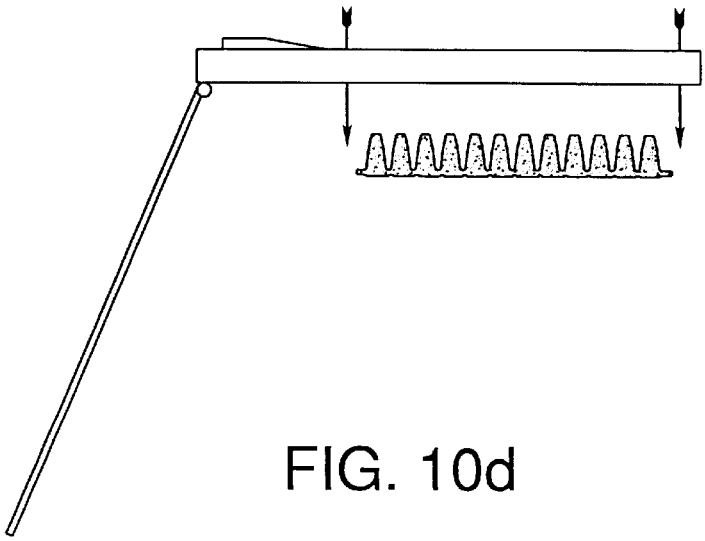

As shown in FIGS. 9*a*–9*c*, in an alternative embodiment, instead of the blade 75 that includes the two-dimensional array of crescent blades 93, one large blade 101 is utilized. In this embodiment, a microtitre tray is inserted into a holder as described above in connection with the previous embodiment. However, in this embodiment, the large blade 101 is pushed across a cutting surface 103 of its tray holder as shown in FIGS. 10*a*–10*d*, thereby cutting bottom sections of wells of the microtitre tray.

In another alternative embodiment, a blade and a ruler or other similar devices having straight edges can be provided so that bottom sections of wells can be severed without having to use a structure similar to that of the microtitre tray holder discussed above as long as the microtitre tray to be cut is held so as to render it immovable.

In yet another embodiment, the cutting process can be fully automated. The automated cutting tool may include a large blade securely affixed to slide across a cutting plane, which divides bottom sections from the rest of microtitre trays, and a microtitre holder to securely hold a microtitre tray. In other words, while the microtitre holder securely holds the microtitre tray to be cut, the blade severs the bottom sections of the wells. It should be noted that this automated cutting tool can be implemented in an assembly line-like setting.

Although the preferred embodiments of the invention have been described in the foregoing description, it will be understood that the present invention is not limited to only specific preferred embodiments described herein. It should be understood that the materials used and the mechanical detail maybe slightly different or modified from the description herein without departing from the methods and composition disclosed and taught by the present invention as recited in the claims.

What is claimed is:

1. A method of manufacturing a spill-resistant microtitre tray structure, comprising:

providing a modified microtitre tray which includes regularly spaced apart wells, each well having an open top and an open bottom located at opposite ends of the well;

providing an unmodified microtitre tray which includes wells having a same spacing as those of the modified microtitre tray, each well having an open top and a closed bottom located at opposite ends of the respective well, a shape of the wells belonging to the unmodified tray being identical to a shape of the wells belonging to the modified tray except for the open bottoms of the wells on the modified tray; and inserting at least a plurality of wells of the modified microtitre tray into a plurality of wells of the unmodified microtitre tray, to thereby form a stacked arrangement in which the plurality of wells of the modified microtitre tray serve as spill-resistant lids for the wells of the unmodified microtitre tray into which the plurality of wells are inserted.

2. The method according to claim 1 wherein the modified microtitre tray is provided by molding a microtitre tray having wells with open tops and open bottoms.

3. The method according to claim 1 wherein the modified microtitre tray is provided by severing bottoms of wells of a microtitre tray having wells with closed bottoms.

4. The method according to claim 3 wherein the step of severing the bottom sections further includes the step of:

simultaneously cutting the bottom section of each well.

5. The method according to claim 1, wherein the modified tray and the unmodified tray are identical in shape, except for the open bottoms of the wells on the modified tray.

6. A spill-resistant microtitre tray structure, comprising:

a modified microtitre tray including regularly spaced apart wells, each well having an open top and an open bottom located at opposite ends of the well; and an unmodified microtitre tray which includes wells having a same spacing as those of the modified microtitre tray, each well having an open top and a closed bottom located at opposite ends of the well, wherein at least a plurality of the wells of the modified microtitre tray are inserted into a plurality of wells of the unmodified microtitre tray to thereby form a stacked arrangement in which the plurality of wells of the modified microtitre tray serve as spill-resistant lids for the plurality of wells of the unmodified microtitre tray, and wherein a shape of the wells belonging to the unmodified tray is identical to a shape of the wells belonging to the modified tray except for the open bottoms of the wells on the modified tray.

7. The structure according to claim 6 wherein the open tops and open bottoms of the plurality of wells of the modified microtitre tray are sufficiently large to receive a plurality of probes.

8. The structure according to claim 6 wherein the plurality of wells of the modified microtitre tray are made from a semi-rigid plastic material such that the plurality of wells of the modified microtitre tray are deformed when inserted into the plurality of wells of the unmodified microtitre tray, to thereby form a friction fit between the modified microtitre tray and the unmodified microtitre tray.

9. The structure according to claim 6 wherein the stacked arrangement includes a contact region where the unmodified and modified trays touch each other, and wherein the contact region includes an adhesive.

10. The structure according to claim 6, wherein each of the modified and unmodified microtitre trays includes a two dimensional array of wells.

11. The spill-resistant microtitre tray structure according to claim 6, wherein the modified tray and the unmodified tray are identical in shape, except for the open bottoms of the wells on the modified tray.

* * * * *